US009988862B2

(12) United States Patent
Triche et al.

(10) Patent No.: US 9,988,862 B2
(45) Date of Patent: Jun. 5, 2018

(54) ELEVATOR ROLLER INSERT SYSTEM

(71) Applicant: CAJUN SERVICES UNLIMITED, LLC, Houma, LA (US)

(72) Inventors: Shane Joseph Triche, Houma, LA (US); Heath Lawrence Triche, Gray, LA (US)

(73) Assignee: Cajun Services Unlimited, LLC, Gray, LA (US)

( * ) Notice: Subject to any disclaimer, the term of this patent is extended or adjusted under 35 U.S.C. 154(b) by 0 days. days.

(21) Appl. No.: 15/679,696

(22) Filed: Aug. 17, 2017

(65) Prior Publication Data

US 2017/0342784 A1 Nov. 30, 2017

Related U.S. Application Data

(63) Continuation of application No. PCT/US2016/023686, filed on Mar. 23, 2016.

(60) Provisional application No. 62/136,978, filed on Mar. 23, 2015, provisional application No. 62/292,988, filed on Feb. 9, 2016.

(51) Int. Cl.
*E21B 19/06* (2006.01)
*E21B 3/02* (2006.01)

(52) U.S. Cl.
CPC ..... *E21B 19/06* (2013.01); *E21B 3/02* (2013.01)

(58) Field of Classification Search
CPC ..... E21B 19/06; E21B 19/16; E21B 19/161; E21B 19/167; E21B 19/168; E21B 19/18; E21B 19/24
See application file for complete search history.

(56) References Cited

U.S. PATENT DOCUMENTS

| | | | |
|---|---|---|---|
| 2,172,908 | A | 9/1939 | Jack |
| 2,722,450 | A | 11/1955 | Nelson |
| 3,061,011 | A | 10/1962 | Paget |
| 4,152,953 | A | 5/1979 | Headley |
| 4,404,876 | A | 9/1983 | Eckel |
| 4,591,007 | A | 5/1986 | Shaginian et al. |

(Continued)

OTHER PUBLICATIONS

International Search Report for International Patent Application No. PCT/US2016/023686, dated Jun. 20, 2016, 3 pages.

(Continued)

*Primary Examiner* — Giovanna C. Wright
*Assistant Examiner* — Jonathan Malikasim
(74) *Attorney, Agent, or Firm* — Sheridan Ross P.C.

(57) ABSTRACT

A device, system, and/or method for reducing friction required to rotate a tubular within an elevator during the process of running tubulars in an oil and gas well are provided. An elevator roller insert may be used in conjunction with an elevator, such as a single joint elevator. Such an insert may comprise upper and lower rollers which are positioned on upper and lower roller sets or a combination roller set containing multiple upper and/or lower rollers. The result is the provision of a plurality of rollers which bear the weight of a tubular yet still allow the tubular to rotate rather freely, facilitating the maintenance of proper thread integrity of the connections while making up a stand to a string of tubulars as well as preventing the loss of resources due to galled or crushed threads or a tubing segment or stand falling to the rig floor.

28 Claims, 6 Drawing Sheets

(56) References Cited

U.S. PATENT DOCUMENTS

| | | | | |
|---|---|---|---|---|
| 5,083,356 | A * | 1/1992 | Gonzalez | E21B 19/00 29/429 |
| 5,297,833 | A | 3/1994 | Willis et al. | |
| 5,755,289 | A | 5/1998 | Angman et al. | |
| 5,967,477 | A | 10/1999 | Walmsley | |
| 6,000,472 | A | 12/1999 | Albright et al. | |
| 6,056,060 | A | 5/2000 | Abrahamsen et al. | |
| 6,073,699 | A | 6/2000 | Hollingsworth, Jr. | |
| 7,350,586 | B2 | 4/2008 | Guidry | |
| 8,141,923 | B2 | 3/2012 | Bouligny et al. | |
| 2002/0144575 | A1 | 10/2002 | Niven | |
| 2013/0146304 | A1 | 6/2013 | Sonnier | |

OTHER PUBLICATIONS

Written Opinion for International Patent Application No. PCT/US2016/023686, dated Jun. 20, 2016, 5 pages.

Offshore Energy Services "OES CSE Animation," YouTube, Jun. 22, 2015, 6 pages [retrieved online from: www.youtube.com/watch?v=OxvrVhIJvQQ].

U.S. Appl. No. 15/872,671, filed Jan. 16, 2018, Triche et al.

International Preliminary Report on Patentability for International (PCT) Patent Application No. PCT/US2016/023686, dated Oct. 5, 2017 7 pages.

* cited by examiner

ELEVATOR ROLLER INSERT SYSTEM

CROSS REFERENCE TO RELATED APPLICATION

This application is a continuation application under 35 U.S.C. § 111(a) of PCT Application No. PCT/US2016/023686 having an international filing date of Mar. 23, 2016, which designated the United States, which PCT application claims the benefit of U.S. Application Ser. No. 62/136,978, filed on Mar. 23, 2015 and U.S. Application Ser. No. 62/292,988, filed Feb. 9, 2016, all of which are incorporated by reference in their entirety.

FIELD OF THE INVENTION

The invention relates to an apparatus and methods, in certain embodiments, to reduce the friction required to rotate a tubular within a single joint elevator during the process of running tubulars in an oil and gas well. The invention would eliminate the need for the elevator to have to rotate and reduce the amount of torque required to rotate the tubular on stationary elevators. This would allow most tubular connections to be started by hand with the use of a strap wrench. In particular, but not exclusively, the invention relates to a tool for, and a method of, reducing the torque required to rotate a tubular within an elevator while running and making up tubulars in the oil and gas industry. This tool may complement elevators that utilize die sets or inserts to adjust the internal diameter of the elevator to match a range of tubular sizes. This tool may be used to run any sized tubular, including tubulars from 2⅜ inches to 20 inches.

BACKGROUND AND SUMMARY OF THE INVENTION

In the oil and gas industry, wellbores are drilled into the earth using drilling rigs, where tubulars are threaded together to form long tubular strings that are inserted into the wellbore to extract the desired fluid. The tubing string is generally suspended in the borehole using a rig floor-mounted spider, such that each new tubular segment or stand may be threaded onto the end of the previous tubular just above the spider. A segment is generally considered one joint of tubing and a stand is generally considered to be two or three joints of tubing combined together. A single joint elevator is commonly used to grip and secure the segment or stand to a hoist to lift the segment or stand into position for threading the tubulars together. Sometimes compensators are used in combination with elevators to reduce the weight of the stand on the connection of the previous string. Once set into position the tubular is rotated with a power tong in the elevator or the entire elevator is allowed to rotate on a swivel with the tubular to allow the connections to be threaded.

In general, single joint elevators are specifically adapted for securing and lifting tubular segments having a conventional connection, such as an internally threaded sleeve that receives and secures an externally threaded end from each of two tubular segments to secure the segments in a generally abutting relationship. The internally threaded sleeve is first threaded onto the end of a first tubular string to form a "box-end." The externally threaded "pin end" of a second tubular string is then threaded into the box end to complete the connection between the two strings. These elevators have a circumferential shoulder that forms a circle upon closure of the hinged body halves. The shoulder of the elevator engages the shoulder formed between the end of the sleeve and the pipe segment.

Other elevators are specifically adapted for securing and lifting tubular segments having integral connections. These integral connections are generally permanently fixed to each end of the tubular, one end having an internally threaded end or "box-end" and the other end having an externally threaded end or "pin-end", in a generally abutting relationship. The externally threaded pin-end of the first tubular segment is then threaded into the internally threaded box-end of the tubular string. These elevators generally have a beveled or angled shoulder that forms a circle upon closure of the hinged body halves. The beveled shoulder engages the beveled end of the integral connection of the pipe segment.

At least one challenge encountered by those in the industry is maintaining proper thread integrity of the connections while making up the stand to the string of tubulars. Generally, if the threads of the two connecting tubulars are not properly aligned when the rotation with power tongs begins, the threads of both connections will usually gall or be crushed to a state of non-compliance with industry standards. Typically these connections will have to be removed from the string and discarded or sent back to the manufacturer to be re-threaded. This removal of tubulars and connections from the string can be time consuming and very costly to the rig operator.

Another such challenge to those in the industry is the ability to run segments or stands of very heavy weight tubing. Generally the face of the internally threaded sleeve of a conventional connection rests on the top of the elevator. If the weight of the tubing segment or stand is too great, the friction between the face of the sleeve and the shoulder of the elevator will cause the sleeve to "stick" and the sleeve will not rotate with the tubing. This eventually causes the sleeve to "back-off" or become disconnected from the tubing, possibly allowing the tubing segment or stand to fall to the rig floor.

Yet another challenge is the safety issue that may arise when allowing the single joint to rotate on a swivel. The possibility exists that if the swivel, or the cable holding the swivel, becomes worn or fatigued to the point of failure, the elevator and the tubing would fall to the rig floor.

Therefore, there is a need for an apparatus or system that allows the tubulars to rotate within the elevator with little required torque. This will allow the operator the ability to start the connection of the tubulars by hand with a strap wrench. Thus, the operator may determine whether or not the threads are aligned properly prior to connecting the power tongs and finishing the make-up of the connection.

An objective of the invention is to provide a system comprising multiple rollers that may be seamlessly integrated into existing elevators which encompass inserts or dies to aid in the process of running tubulars.

A further objective is to provide a means of allowing the tubulars to rotate within the elevator without the need for additional pneumatic or hydraulic control lines or actuation.

A further objective is to provide a means to rotate a stand of multiple tubulars that would have been too heavy or unsafe to rotate using conventional methods.

A further objective is to provide a means to run stands of two or three segments of heavy weight tubing instead of a single segment, significantly reducing the time required to run the tubing in the well.

An apparatus of this nature may also significantly reduce the amount of loss time and money due to galled or destroyed connections.

An apparatus of this nature may significantly reduce safety concerns by replacing the need to hang the elevator with cables and a swivel, and also to reduce the possibility of spinning off the upper collar holding the stand on the elevator.

An apparatus of this nature may comprise rollers that encompass a shaft with an arrangement of radial and/or thrust bearings contained within a cylindrical hub.

An apparatus of this nature may comprise rollers that encompass a single ball bearing fixed within a housing.

An apparatus of this nature may typically have rollers that will be oriented vertically or at a specified angle from the vertical in combination with rollers that will be aligned with the vertical or horizontal.

An apparatus of this nature may have interchangeable components that can be replaced in the field thus reducing downtime and ensure proper rotation of the tubular.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate certain embodiments of the disclosure and together with the general description of the disclosure given above and the detailed description of the drawings given below, serve to explain the principles of the disclosures.

Figure 1A:
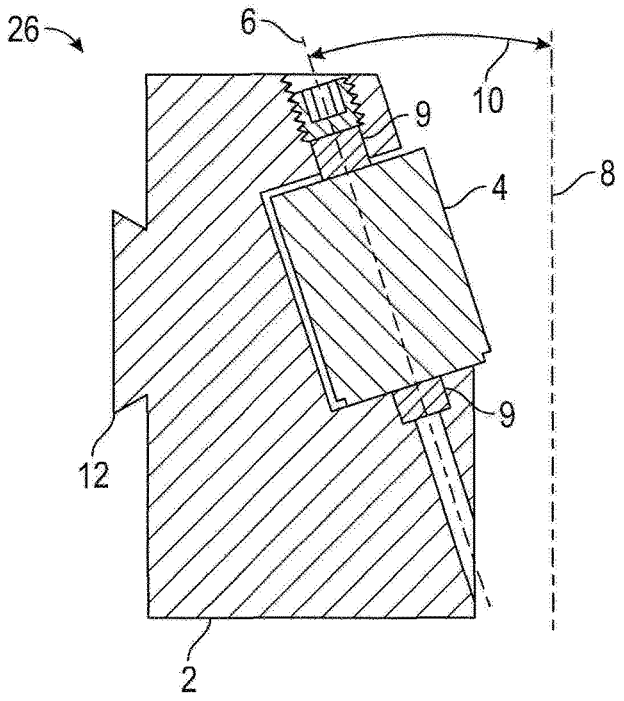
FIG. 1*a* is a section view of a single upper roller block in accordance with embodiments of the invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. It is expressly understood that although the figures depict tubulars, inserts, and elevators, the invention is not limited to these embodiments.

Now referring to FIG. 1*a*, an upper roller set 26 is provided with an upper roller 4 positioned within a recess of the upper roller block 2, the upper roller 4 having a rotational axis 6 about which the upper roller 4 rotates to accommodate tubulars being handled by an elevator. In some embodiments, upper roller 4 may comprise a combination of axial and thrust bearings encased within a roller housing and rotating about a central shaft 9. Also, as it can be appreciated by one skilled in the art, in certain embodiments, the types and sequence of bearings may be different than discussed herein to accommodate the different types of tubing and tubing connections being handled by an elevator. A plurality of upper roller sets 26 can form an elevator roller insert 30 (shown in FIG. 3 below) that bears the weight of a tubular yet still allows the tubular to rotate rather freely. To bear the weight of the tubular and to allow free rotation of the tubular, the upper roller 4 is configured to have a maximum operating weight and a maximum load rating. In some embodiments, the maximum operation weight for an upper roller 4 is 4,350 lbs and the maximum load rating is 6,300 lbs. It will be appreciated that in other embodiments, the maximum operation weight and the maximum load rating for an upper roller 4 may be greater or less than 4,350 lbs and 6,300 lbs, respectively.

In the embodiment shown in FIG. 1*a*, the rotational axis 6 of the upper roller 4 is offset in a transverse direction from a central axis 8 of a complete elevator roller insert 30 (shown in FIGS. 3 and 4 below). Also, rotational axis 6 of the upper roller 4 may be offset from the vertical by an upper roller angle 10. In various embodiments, the upper roller angle 10 is approximately 0, 5, 12 or 18 degrees to match common tubular connection angles. In other embodiments, the upper roller angle 10 ranges from 0 to 90 degrees.

In some embodiments, the upper roller set 26 is also comprised of a connection 12 which allows the roller block to be fixed to the elevator in some abutting fashion. In some embodiments this connection will be a dovetail type connection. In other embodiments the connection type may match that of the elevator that the inserts will be used in.

Figure 1B:
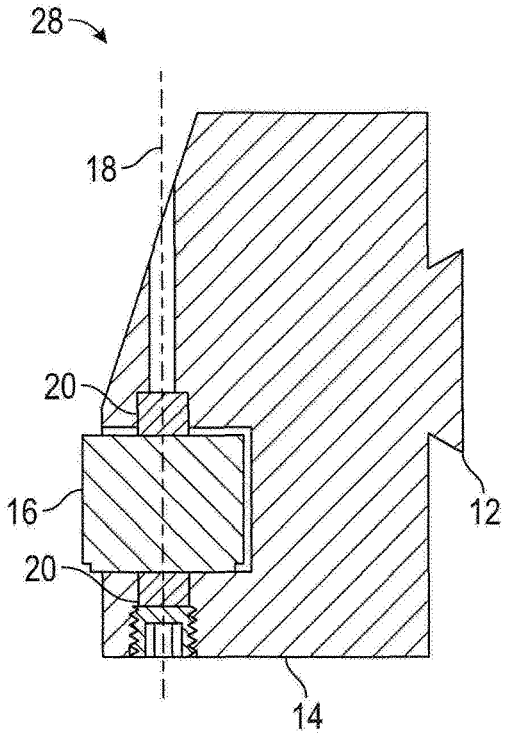
FIG. 1*b* is a section view of a single lower roller block in accordance with embodiments of the invention.

Now referring to FIG. 1*b*, a lower roller set 28 is provided with a lower roller 16 positioned within a recess of the lower roller block 14. The lower roller 16 has a rotational axis 18 about which the lower roller 16 rotates to prevent a tubular from binding against the elevator roller insert 30 should the elevator be tilted or off center. The lower roller 16 may comprise a combination of axial and thrust bearings encased within a roller housing and rotating about a central shaft 20. Also, as it can be appreciated, in certain embodiments, the types and sequence of bearings may be different than discussed here to accommodate the different types of tubing and tubing connections being handled by an elevator. In the embodiment shown in FIG. 1*b*, the rotational axis 18 of the lower roller 16 is substantially parallel with a central axis of the complete elevator roller insert 30 (shown in FIGS. 3 and 4 below), or a central axis of a roller set. However, in some embodiments, the rotational axis 18 of the lower roller 16 may form a lower roller angle similar to the upper roller angle 10. In various embodiments, the lower roller angle may be between approximately 0 and 90 degrees.

In some embodiments, the lower roller set 28 may also be comprised of a connection 12 which allows the roller block to be fixed to the elevator in some abutting fashion. In some embodiments this connection will be a dovetail type connection. In other embodiments the connection type will match that of the elevator that the inserts will be used in.

Figure 2A:
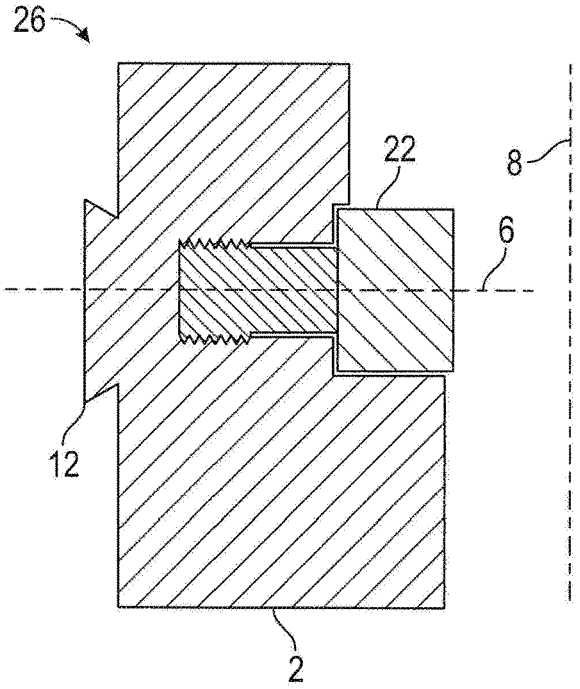
FIG. 2*a* is a section view of a single upper roller block utilizing a cam follower roller in accordance with embodiments of the invention.

Now referring to FIG. 2*a*, some embodiments of the upper roller set 26 may utilize a cam follower roller 22 instead of an upper roller 4 with bearings as depicted in FIG. 1*a*. Cam follower rollers are well known to those skilled in the art, and an exemplary cam follower roller is disclosed by U.S. Pat. No. 4,152,953, which is incorporated herein in its entirety by reference. The cam follower roller 22 would be threaded or otherwise secured into the upper roller block 2 and would bear the weight of the tubular being handled by the elevator 40. The cam follower roller would be oriented along a rotational axis 6 similar to that of the upper roller 2 in FIG. 1*a*, and its utilization would also be similar.

Figure 2B:
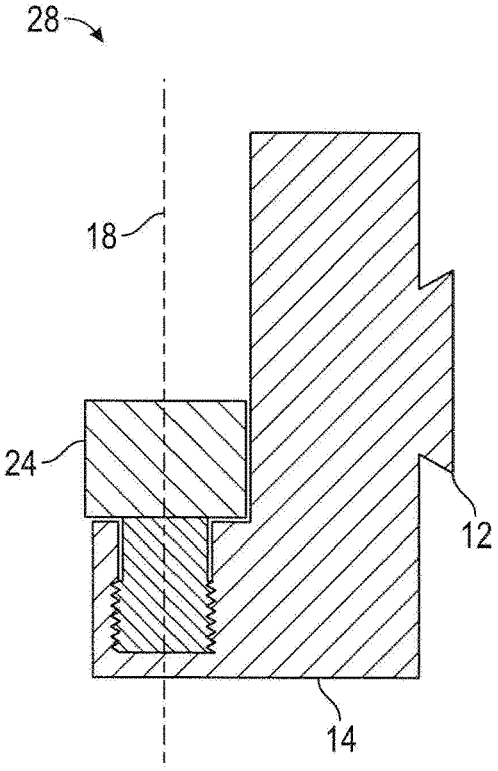
FIG. 2*b* is a section view of a single lower roller block utilizing a cam follower roller in accordance with embodiments of the invention.

Now referring to FIG. 2*b*, some embodiments of the lower roller block 14 may utilize a cam follower roller 24 instead of a lower roller 16 with bearings as depicted in FIG. 1*b*. The cam follower roller 24 would be threaded or otherwise secured into the lower roller block 14 and rotate to prevent a tubular from binding against an insert should the elevator be tilted or off center. In some embodiments, the cam follower roller is oriented along a rotational axis 18 similar to that of the lower roller in FIG. 1*b*, and its utilization would also be similar.

Figure 3:
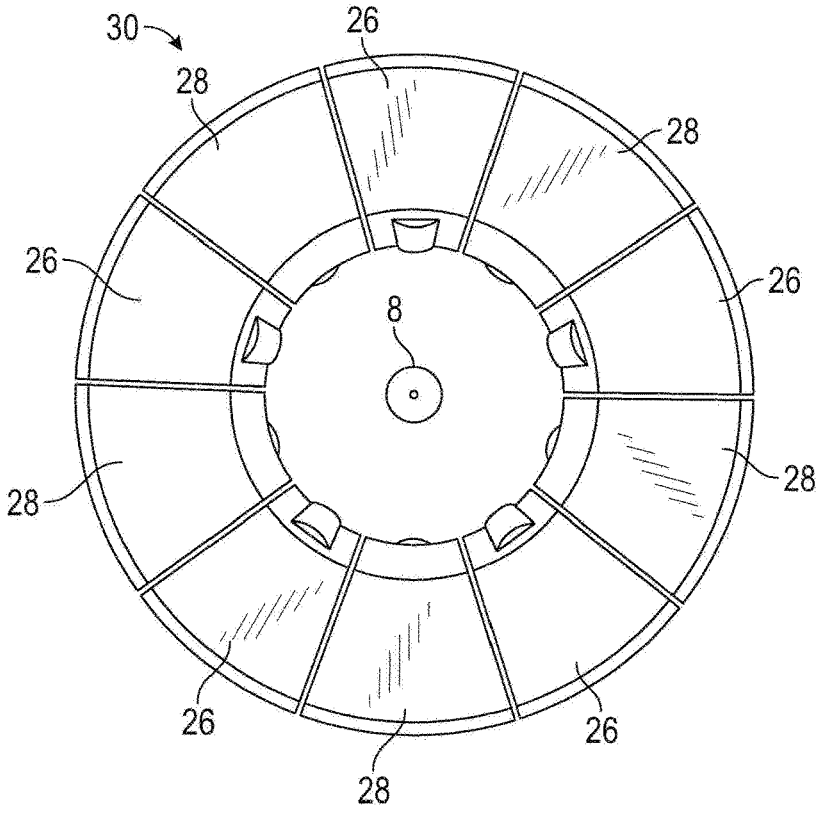
FIG. 3 is a top view of an elevator roller insert utilizing an arrangement of single upper and lower roller blocks in accordance with embodiments of the invention.
Figure 4:
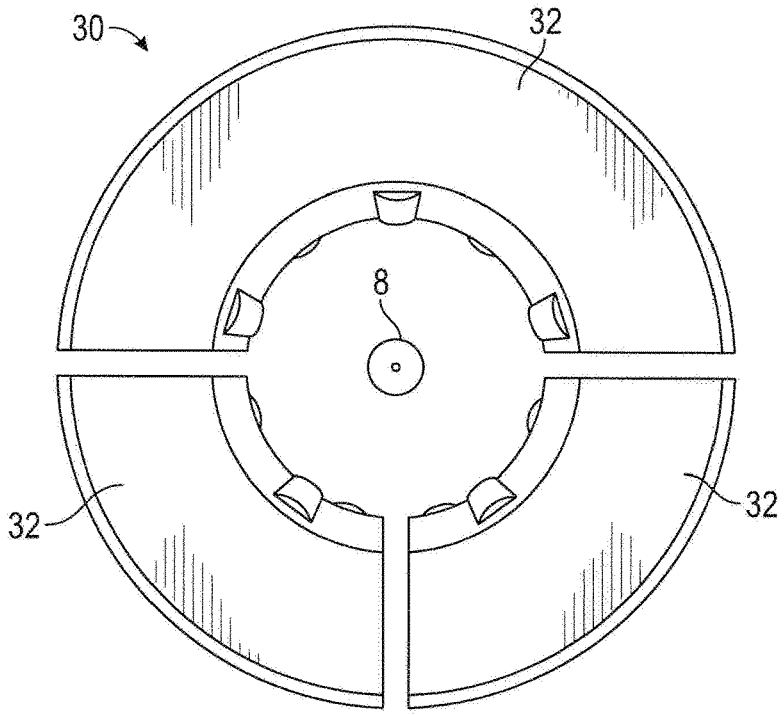
FIG. 4 is a top view of an elevator roller insert utilizing an arrangement of multiple roller blocks in accordance with embodiments of the invention.

Now referring to FIG. 3, a combination of upper roller sets 26 and a combination of lower roller sets 28 may be combined to form an elevator roller insert 30. A plurality of upper roller blocks 2 are arranged about the central axis 8 of the elevator roller insert 30 to form the upper roller set 28, and similarly, a plurality of lower roller blocks 14 are arranged about the central axis 8 of the elevator roller insert 30 to form the lower roller set 28. The upper and lower roller sets 26, 28 may then combine to form a complete elevator roller insert 30. In some embodiments the upper rollers may be combined in the same block with the lower rollers (combination block 32) in a single or multiple block set as can be seen in FIG. 4. In other embodiments there may be no lower roller sets 28 included in the elevator roller insert 30.

The elevator roller insert 30 may comprise various numbers of upper roller sets 26 and lower roller sets 28. For example, in some embodiments, the elevator roller insert 30 comprises four upper roller sets 26 and four lower roller sets 28. It will be appreciated that in other embodiments, the number of upper roller sets 26 and/or the number of lower roller sets 28 may be greater or less than four. Further, the number of upper roller sets 26 may be distinct from the number of lower roller sets 28. In addition, FIG. 4 depicts an elevator roller insert 30 having three combination roller sets 32, but it will be appreciated that the elevator roller insert 30 may have more or less than three combination roller sets 32. As stated above, the rollers may have a maximum operating load and/or a maximum load rating, and similarly, the complete elevator roller insert 30 may also have a maximum operating load and/or a maximum load rating.

Figure 5:
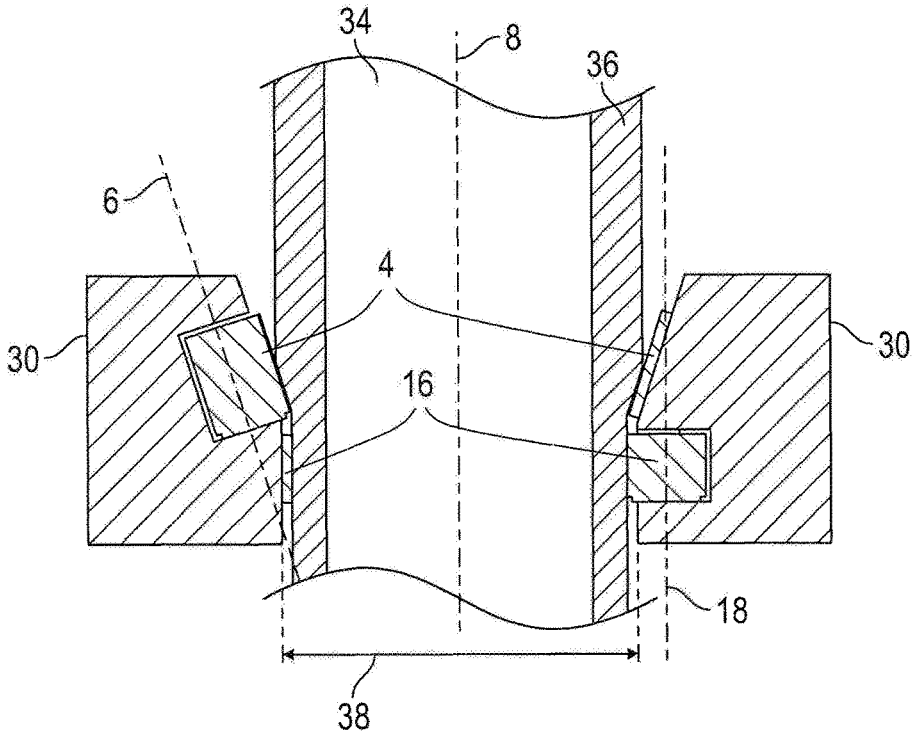
FIG. 5 is a section view of a segment of tubing having an integral (beveled) connection within the roller insert in accordance with embodiments of the invention.

Now referring to FIG. 5, a cross section is shown comprising of a tubing 34 with an integral connection 36 being held in place by the upper rollers 4 in a generally abutting relationship. Due to the weight bearing rotational capabilities of the upper roller 4, the tubing 34 will be allowed to rotate rather freely within the elevator roller insert 30. The upper roller angle 10 is designed such that it will closely match the angle of the integral connection 36. The lower rollers 16 will then hold the tubing 34 centrally within the elevator roller insert 30 and, in the same manner as the upper rollers 4, would allow the tubular 34 to rotate rather freely. Also the upper 26 and lower roller sets 28 (or combination roller sets 32 in some embodiments) are radially aligned in a manner that the minimum internal diameter 38 of the elevator roller insert 30 is less than the greatest outer diameter of the integral connection 36. The internal diameter 38 of the elevator roller insert 30 keeps the tubular 34 from slipping through the insert 30 and falling to the rig floor.

Figure 6A:
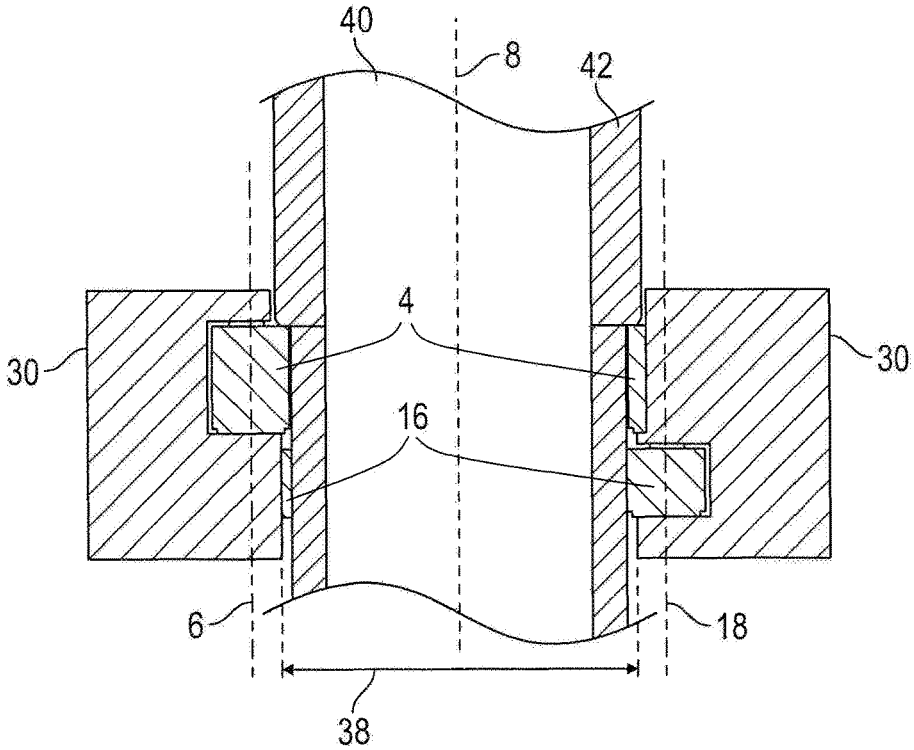
FIG. 6A is a section view of a segment of tubing having a conventional (collared) connection within the roller insert in accordance with embodiments of the invention.
Figure 6B:
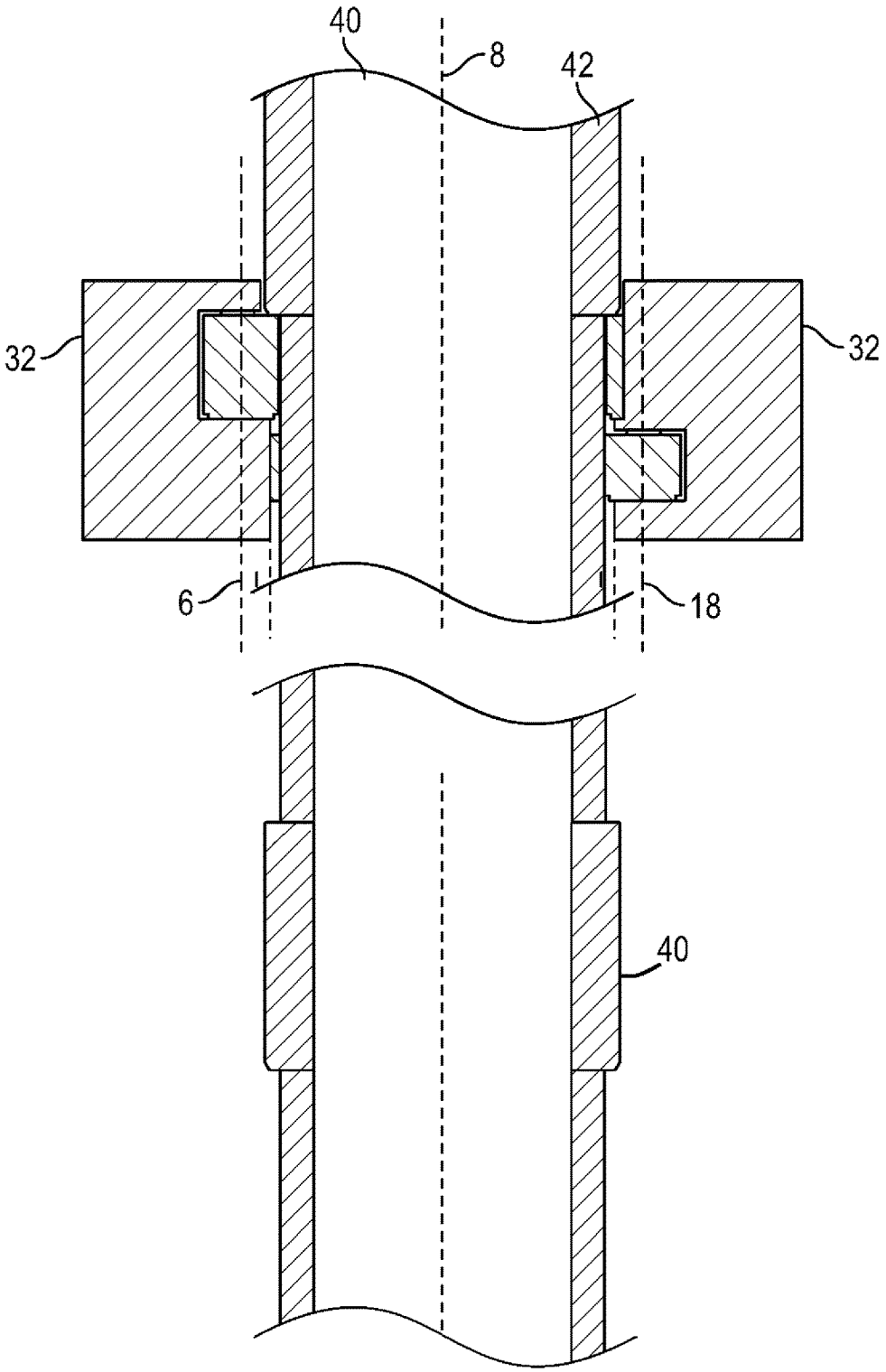
FIG. 6B is a section view of multiple segments of tubing where one segment of tubing has a conventional (collared) connection within the roller insert in accordance with embodiments of the invention.

Now referring to FIGS. 6*a* and 6*b*, a cross section is shown comprising of tubing 40 with an internally threaded sleeve 42 being held in place by the upper rollers 4 in a generally abutting relationship such that a first outer face contacts a box end of the tubing 40 and a second outer face contacts a body of the tubing 40. Due to the weight bearing rotational capabilities of the upper roller 4, the tubing 40 will be allowed to rotate rather freely within the elevator roller insert 30. The lower rollers 16 will then hold the tubing 40 centrally within the elevator roller insert 30 where an outer face contacts the body of the tubing 40 and, in the same manner as the upper rollers 4, would allow the tubular 40 to rotate rather freely. Also the upper 26 and lower 28 roller sets (or combination roller sets 32 in some embodiments) are radially aligned in a manner that the minimum internal diameter 38 of the elevator roller insert 30 is less than the greatest outer diameter of the sleeve 42. The internal diameter 38 of the elevator roller insert 30 keeps the tubular 40 from slipping through the elevator roller insert 30 and falling to the rig floor.

Figure 7A:
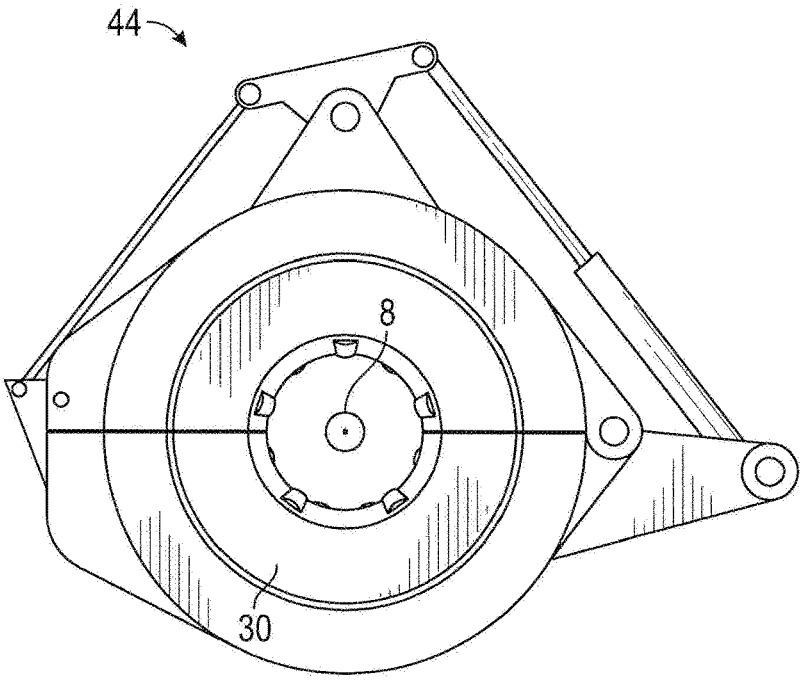
FIG. 7*a* is a top view of a single joint elevator encompassing an elevator roller insert in a closed position in accordance with embodiments of the invention.
Figure 7B:
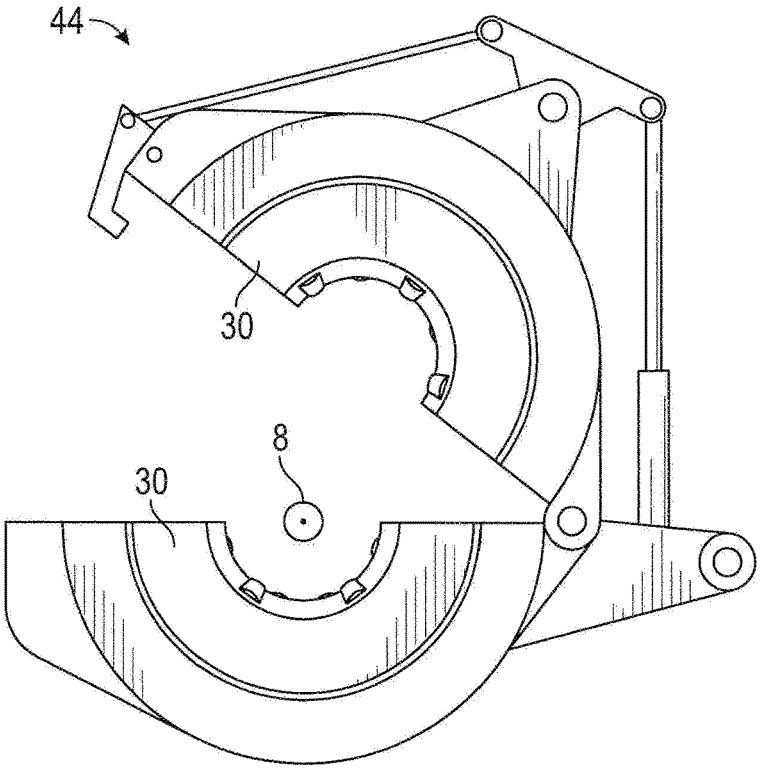
FIG. 7*b* is a top view of a single joint elevator encompassing an elevator roller insert in an open position in accordance with embodiments of the invention.

And now referring to FIGS. 7*a* and 7*b*, an elevator roller insert 30 is shown within a single joint elevator 44 in the closed and opened position respectively. The elevator roller insert 30 is generally segmented to allow the elevator be opened, to accept the tubular, and closed, to contain the tubular within the elevator.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. An elevator roller system for a drilling rig, comprising:

a tubular having an upper outer diameter and a lower outer diameter, wherein the upper outer diameter is larger than the lower outer diameter;

an elevator having:

a first arm having an interior surface;

a second arm having an interior surface, the first and second arms hingedly interconnected and rotatable between an open position and a closed position, wherein the interior surfaces of the arms form an aperture with a central axis in the closed position;

a plurality of upper recesses and a plurality of lower recesses;

a plurality of upper rollers disposed in the plurality of upper recesses and positioned about the central axis of the aperture, wherein the rollers in the plurality of upper rollers each have a rolling shaft oriented substantially parallel with the central axis, and the rolling shaft extends from an upper connection point to a lower connection point within the upper recess, wherein a distance between the upper connection point and the upper outer diameter of the tubular is smaller than a distance between the lower connection point and the lower outer diameter of the tubular;

a plurality of lower rollers disposed in the plurality of lower recesses and positioned about the central axis of the aperture, wherein the rollers in the plurality of lower rollers each have a rolling shaft oriented substantially parallel with the central axis and the rolling shaft extends from an upper connection point to a lower connection point within the lower recess; and wherein the pluralities of upper and lower rollers are configured to contact the tubular when the arms are in the closed position and further wherein the tubular is capable of freely rotating relative to the elevator when the arms are in the closed position.

2. The elevator roller system of claim 1, wherein each roller in the plurality of upper rollers comprises at least one thrust bearing and at least one radial bearing.

3. The elevator roller system of claim 1, wherein the rollers in the plurality of upper rollers are arranged in a first common plane, and wherein the rollers in the plurality of lower rollers are arranged in a second common plane.

4. The elevator roller system of claim 1, wherein an inner diameter formed by the plurality of upper rollers and an inner diameter formed by the plurality of lower rollers are identical.

5. The elevator roller system of claim 1, wherein the pluralities of upper and lower recesses are disposed in interior surfaces of inserts configured to selectively interconnect to the interior surfaces of the first and second arms.

6. The elevator roller system of claim 1, wherein the upper outer diameter of the tubular is an elevator upset area or coupling of the tubular, and wherein the lower outer diameter of the tubular is a body of the tubular.

7. The elevator roller system of claim 1, wherein the tubular comprises a collar that defines of the upper outer diameter of the tubular, and wherein an upper surface of each roller in the plurality of uppers rollers is configured to receive a lower surface of the collar of the tubular.

8. The elevator roller system of claim 1, wherein the pluralities of upper and lower recesses are disposed in the interior surfaces of the first and second arms.

9. An elevator roller insert, comprising:

an insert having an interior surface and an exterior surface, wherein the interior surface forms an aperture with a central axis, and wherein the exterior surface of the insert is configured to selectively interconnect to an interior surface of an elevator;

a plurality of first rollers disposed on the interior surface of the insert and positioned about the central axis, wherein the plurality of first rollers forms an inner diameter, and the rollers in the plurality of first rollers are freely rotatable;

a plurality of second rollers disposed on the interior surface of the insert and positioned about the central axis, wherein the plurality of second rollers forms an inner diameter, and the rollers in the plurality of second rollers are freely rotatable; and wherein the pluralities of first and second rollers are configured to contact a body of a tubular positioned in the aperture to define a clearance space between an outer surface of the tubular and the interior surface of the insert, and the pluralities of first and second rollers facilitate free rotation of the tubular relative to the elevator while supporting the weight of the tubular.

10. The elevator roller insert of claim 9, wherein the insert is comprised of a plurality of upper roller sets and lower roller sets;

further wherein the plurality of first rollers are disposed on the upper roller sets and the plurality of second rollers are disposed on the lower roller sets.

11. The elevator roller insert of claim 10, wherein each upper roller set is disposed between two lower roller sets and each lower roller set is disposed between two upper roller sets, wherein the plurality of upper and lower roller sets are disposed about the central axis.

12. The elevator roller insert of claim 9, wherein the elevator roller insert is comprised of at least one combination roller set, further wherein the combination roller set is comprised of a combination roller block and at least one upper roller and at least one lower roller.

13. The elevator roller insert of claim 9, wherein the rollers in the plurality of first rollers each have an axis oriented substantially perpendicular with the central axis.

14. The elevator roller insert of claim 9, wherein the rollers in the plurality of first rollers each have an axis oriented at a nonzero angle with the central axis, and the rollers in the plurality of second rollers each have an axis oriented substantially parallel with the central axis.

15. The elevator roller insert of claim 9, wherein each roller in the plurality of first rollers comprises at least one thrust bearing and at least one radial bearing.

16. The elevator roller insert of claim 9, wherein the rollers in the plurality of first rollers are arranged in a first common plane, and wherein the rollers in the plurality of second rollers are arranged in a second common plane.

17. The elevator roller insert of claim 9, wherein the rollers in the plurality of first rollers are upper rollers, and wherein the rollers in the plurality of second rollers are lower rollers positioned below the upper rollers, and further wherein the inner diameter formed by the plurality of first rollers is larger than the inner diameter formed by the plurality of second rollers.

18. The elevator roller insert of claim 9, wherein the rollers in the plurality of first rollers are upper rollers, and wherein the rollers in the plurality of second rollers are lower rollers positioned below the upper rollers, and further wherein the inner diameter formed by the plurality of first rollers and the inner diameter formed by the plurality of second rollers are identical.

19. A method of assembling tubulars using an elevator, comprising:

providing an elevator having:

a first arm having an interior surface;

a second arm having an interior surface, the first and second arms hingedly interconnected and rotatable between an open position and a closed position, wherein the interior surfaces of the arms form an aperture with a central axis in the closed position;

a plurality of first rollers disposed in the interior surfaces of the first and second arms and positioned about the central axis of the aperture, wherein the rollers in the plurality of first rollers are freely rotatable, and each roller has a first outer face and a second outer face;

a plurality of second rollers disposed in the interior surfaces of the first and second arms and positioned about the central axis of the aperture, wherein the rollers in the plurality of second rollers are freely rotatable, and each roller has an outer face;

positioning a first tubular in the aperture of the first and second arms of the elevator, the first tubular having a box end, a pin end, a body between the box end and the pin end, and a transition portion between the box end and the body, wherein the box end of the first tubular has an outer diameter that is greater than an inner diameter formed by the plurality of second rollers;

moving the first tubular into contact with the pluralities of first and second rollers, wherein the transition portion of the first tubular contacts the first outer face of the rollers in the plurality of first rollers to bear the weight of first tubular, and the body of the first tubular contacts the second outer face of the rollers in the plurality of first rollers and contacts the outer face of the rollers in the plurality of second rollers to align the first tubular with the central axis; and freely rotating the first tubular relative to the elevator and selectively interconnecting the pin end of the first tubular to a box end of a second tubular.

20. The method of claim 19, wherein the rollers in the plurality of first rollers are upper rollers, and wherein the rollers in the plurality of second rollers are lower rollers positioned below the upper rollers, and further wherein an inner diameter formed by the plurality of first rollers is larger than the inner diameter formed by the plurality of second rollers.

21. The method of claim 19, wherein the rollers in the plurality of first rollers are upper rollers, and wherein the rollers in the plurality of second rollers are lower rollers positioned below the upper rollers, and further wherein an inner diameter formed by the plurality of first rollers and the inner diameter formed by the plurality of second rollers are identical.

22. The method of claim 19, wherein the pluralities of first and second rollers are disposed in interior surfaces of inserts configured to selectively interconnect to the interior surfaces of the first and second arms.

23. The method of claim 19, wherein each roller in the plurality of first rollers comprises at least one thrust bearing and at least one radial bearing.

24. The elevator roller system of claim 19, wherein the transition portion extends in substantially perpendicular direction from the body of the first tubular.

25. The elevator roller system of claim 19, wherein the transition portion extends at an angle from the body of the first tubular, and the transition portion extends along an axial length of the first tubular.

26. A method of assembling tubulars using an elevator, comprising:

providing an elevator having:

a plurality of upper rollers positioned about a central axis of an aperture of the elevator, wherein the rollers in the plurality of upper rollers are freely rotatable;

a plurality of lower rollers positioned about the central axis of the aperture of the elevator and positioned below the plurality of upper rollers, wherein the rollers in the plurality of lower rollers are freely rotatable, and wherein an inner diameter formed by the plurality of upper rollers is larger than an inner diameter formed by the plurality of lower rollers;

positioning at least one tubular in the elevator such that the at least one tubular contacts the pluralities of upper and lower rollers, wherein a box end of the at least one tubular has an outer diameter that is greater than the inner diameter formed by the plurality of lower rollers; and freely rotating, by an operator, the at least one tubular relative to the elevator to start a selective interconnection between a pin end of the at least one tubular and a box end of another tubular.

27. The method of claim 26, wherein the at least one tubular is a plurality of tubulars.

28. The method of claim 26, wherein the operator freely rotates the at least one tubular using a strap wrench.

* * * * *